US010692476B2

(12) United States Patent
Chiappetta

(10) Patent No.: US 10,692,476 B2
(45) Date of Patent: Jun. 23, 2020

(54) INSTRUMENT STRING CLEANER

(71) Applicant: David Chiappetta, Brooklyn, NY (US)

(72) Inventor: David Chiappetta, Brooklyn, NY (US)

( * ) Notice: Subject to any disclaimer, the term of this patent is extended or adjusted under 35 U.S.C. 154(b) by 122 days.

(21) Appl. No.: 15/408,650

(22) Filed: Jan. 18, 2017

(65) Prior Publication Data

US 2017/0206865 A1 Jul. 20, 2017

Related U.S. Application Data

(60) Provisional application No. 62/280,107, filed on Jan. 18, 2016.

(51) Int. Cl.

| | |
|---|---|
| ***G10D 3/00*** | (2020.01) |
| ***G10D 3/10*** | (2006.01) |
| ***B08B 1/00*** | (2006.01) |

(52) U.S. Cl.

CPC ..... *G10D 3/00* (2013.01); *B08B 1/008* (2013.01); *G10D 3/10* (2013.01)

(58) Field of Classification Search

CPC ..... B08B 1/008; B08B 1/006; G10D 3/00; G10D 3/10; A41F 3/02; Y10T 24/203; Y10T 24/1391; A47L 13/46; A47L 13/146

See application file for complete search history.

(56) References Cited

U.S. PATENT DOCUMENTS 5,569,863 A * 10/1996 Lem ..... G10D 3/046 84/312 R
8,132,286 B2 3/2012 Chiappetta
2003/0046846 A1* 3/2003 Goodman ..... G09F 3/20 40/658
2006/0048793 A1 3/2006 Chiappetta
2009/0308411 A1* 12/2009 Chiappetta ..... B08B 1/008 134/6
2012/0284974 A1 11/2012 Chiappetta

FOREIGN PATENT DOCUMENTS

DE 3003402 A1 * 8/1981 ..... G10D 3/00
GB 2222298 A * 2/1990 ..... G10D 3/00

OTHER PUBLICATIONS

Abstract of DE3003402A1 (Year: 1981).*

* cited by examiner

*Primary Examiner* — Douglas Lee
(74) *Attorney, Agent, or Firm* — Daniel M. Cohn; Howard M. Cohn

(57) ABSTRACT

An instrument string cleaner adapted for cleaning the strings of a stringed instrument. The string cleaner includes a clamping mechanism that is adapted to securely connect with and hold onto the strings of a stringed instrument. The clamping mechanism includes a top arched plate and a bottom arched plate held together with a pin that extends the width of the top and bottom plates. A coil spring has the pin extending there through. The string cleaner is normally biased to a closed position by the coil spring where the top and bottom arched plates are pressed against each other. The string cleaner has an open position where the top and bottom arched plates are spaced from each other. A first cleaning pad attached to the top arched plate, and second cleaning pad is attached to the bottom arched plate.

8 Claims, 4 Drawing Sheets

INSTRUMENT STRING CLEANER

CROSS-REFERENCE TO RELATED APPLICATIONS

This application claims the benefit of U.S. Provisional Patent Application No. 62/280,107 filed on Jan. 18, 2016, which is incorporated in its entirety herein by reference.

FIELD OF THE INVENTION

The present invention relates generally to a string cleaner. More specifically, the present invention relates to a instrument string cleaner for cleaning the strings of a bowed instrument.

BACKGROUND OF THE INVENTION

Stringed instrument users spend many hours playing their instrument. The playing of stringed instruments is very intense, and requires a lot of time holding and using the instrument. The areas of the instrument that require the most maintenance are the strings and fingerboard. It is very desirable to keep these areas as clean as possible, as much as possible. It is an ultimate goal to keep the instrument in prime playing condition. Such strings are known to be prone to a rapid build up of dirt and sweat both on the top of the strings where the fingers actually touch them but, more especially, underneath the strings. Further, rosin accumulates from the bow and must be regularly removed. The dirt derives not only from particles carried to the strings by the player's fingers but also from particles that are worn off from the fingerboard during playing. The primary effects of this string contamination are to cause the string to rapidly lose its tone becoming less bright and "flat" sounding over a typical timescale of a few hours and to corrode eventually leading to the need for string replacement. A corroded metal string is also more abrasive than a new string so increasing the rate of wear of the frets by the strings.

Time is the factor between how many times a person will clean their stringed instruments strings and fingerboard. It is usually done between string changes or in an unsatisfactory way while the strings are on the instrument. A method to do it very quick and efficient while the strings are in place on the instrument is desirable.

SUMMARY OF THE INVENTION

According to an embodiment of the present invention, there is disclosed an instrument string cleaner adapted for cleaning the strings of a stringed instrument. The string cleaner includes a clamping mechanism that is adapted to securely connect with and hold onto the strings of a stringed instrument. The clamping mechanism includes a top arched plate and a bottom arched plate held together with a pin that extends the width of the top and bottom plates. A coil spring has the pin extending there through, the coil spring having a free end at either end of the coil spring engaging the top arched plate and the bottom arched plate. The string cleaner is normally biased to a closed position by the coil spring where the top and bottom arched plates are pressed against each other. The string cleaner has an open position where the top and bottom arched plates are spaced from each other so that the strings of the instrument can be disposed therebetween. A first cleaning pad attached to a bottom surface of the top arched plate, and a second cleaning pad is attached to a top surface of the bottom arched plate.

According to an embodiment of the present invention, there is disclosed an instrument string cleaner adapted for cleaning the strings of a stringed instrument. The method includes securely connecting a clamping mechanism to the strings of a stringed instrument. Attaching a top arched plate and a bottom arched plate of the clamping mechanism with a pin that extends the width of the top and bottom plates. Providing a first cleaning pad attached to a bottom surface of the top arched plate and a second cleaning pad attached to a top surface of the bottom arched plate. Opening the string cleaner to space the top and bottom arched plates from each other and inserting the bottom arched plate under the strings and the top arched plate above the strings of the instrument. Closing the string cleaner about the strings of the instrument against where the top and bottom arched plates are pressed against each other with the strings in between. Moving the string cleaner can be moved back and forth along the strings to clean a full 360 degrees around the strings. Finally, increasing the cleaning power of the pads by pressing the pads against each other.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

Figure 1:
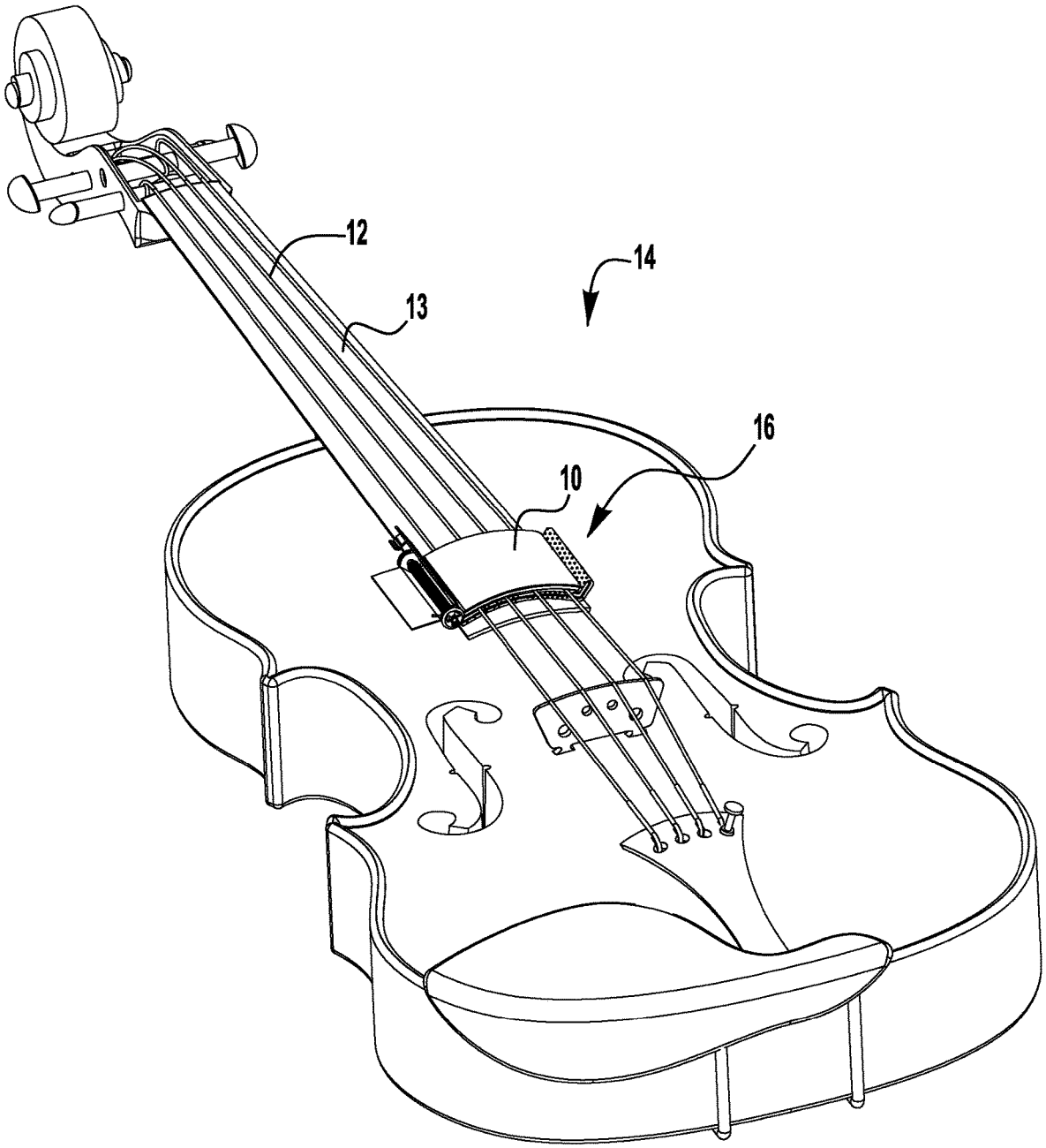

These and other objects of the present invention will become apparent, particularly when taken in light of the following illustrations wherein:

FIG. 1 is a top three dimensional view of a instrument string cleaner mounted on a violin, in accordance with the present invention.

Figure 2A:
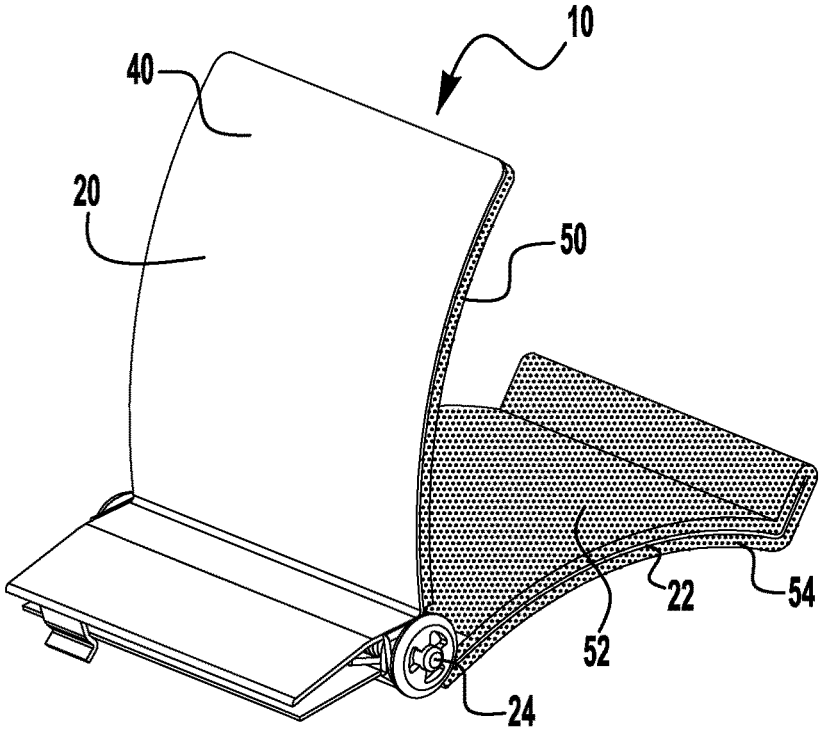

FIG. 2A is a top three dimensional view of the instrument string cleaner in an open position, in accordance with the present invention.

Figure 2B:
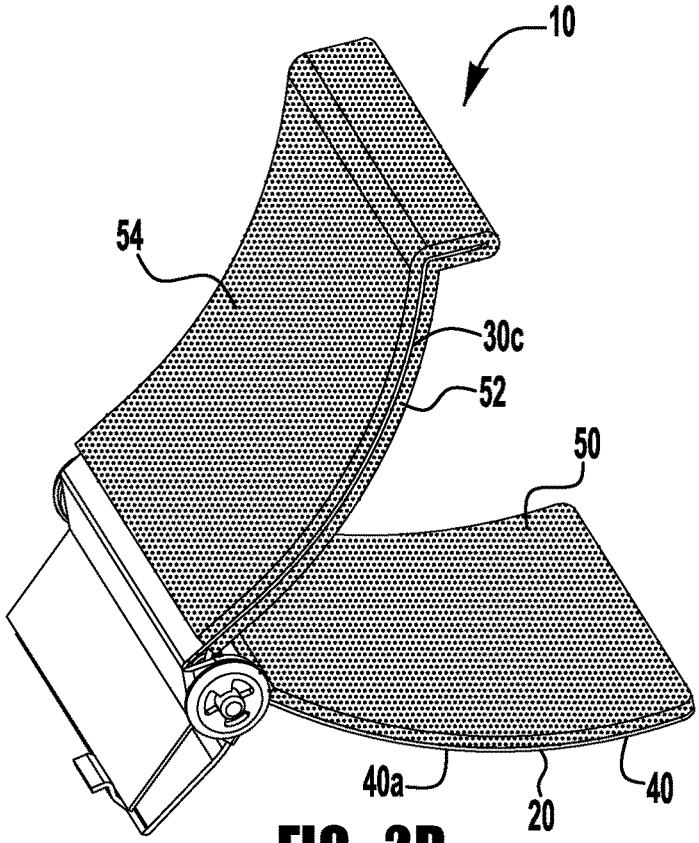

FIG. 2B is a bottom three dimensional view of the instrument string cleaner in an open position, in accordance with the present invention.

Figure 3:
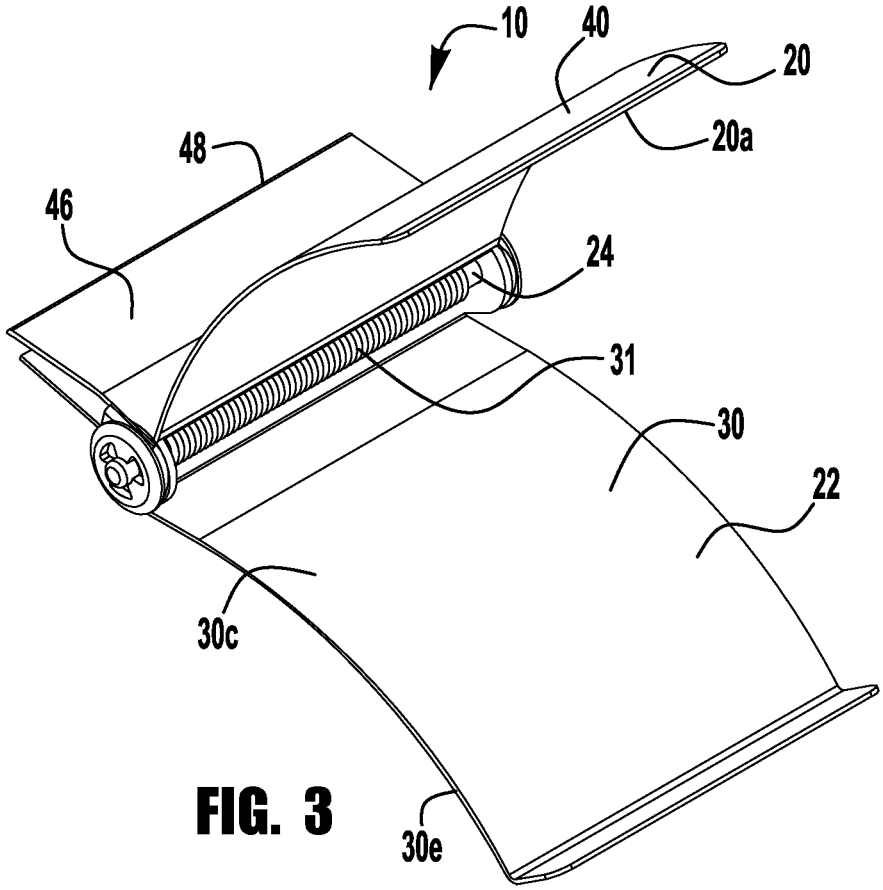

FIG. 3 is a is a front three dimensional view of the structure of the instrument string cleaner in an open position, in accordance with the present invention.

Figure 4:
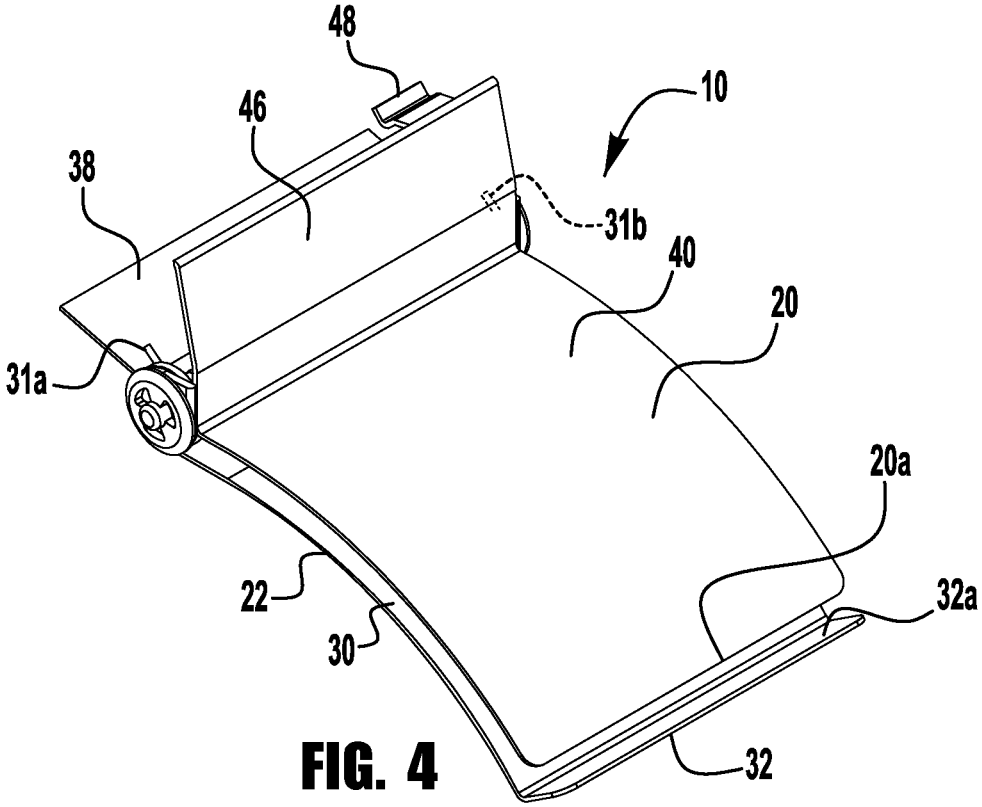

FIG. 4 is a front three dimensional view of the structure of the instrument string cleaner in a closed position, in accordance with the present invention.

Figure 5:
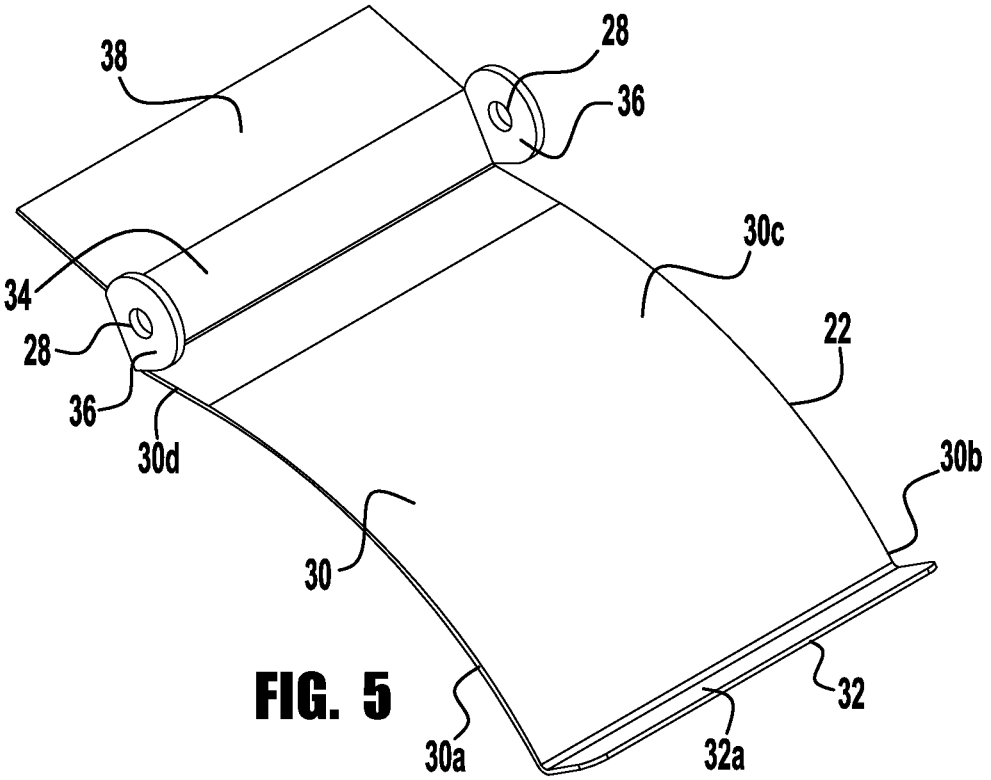

FIG. 5 is a top three dimensional view of the bottom plate of the instrument string cleaner, in accordance with the present invention.

Figure 6:
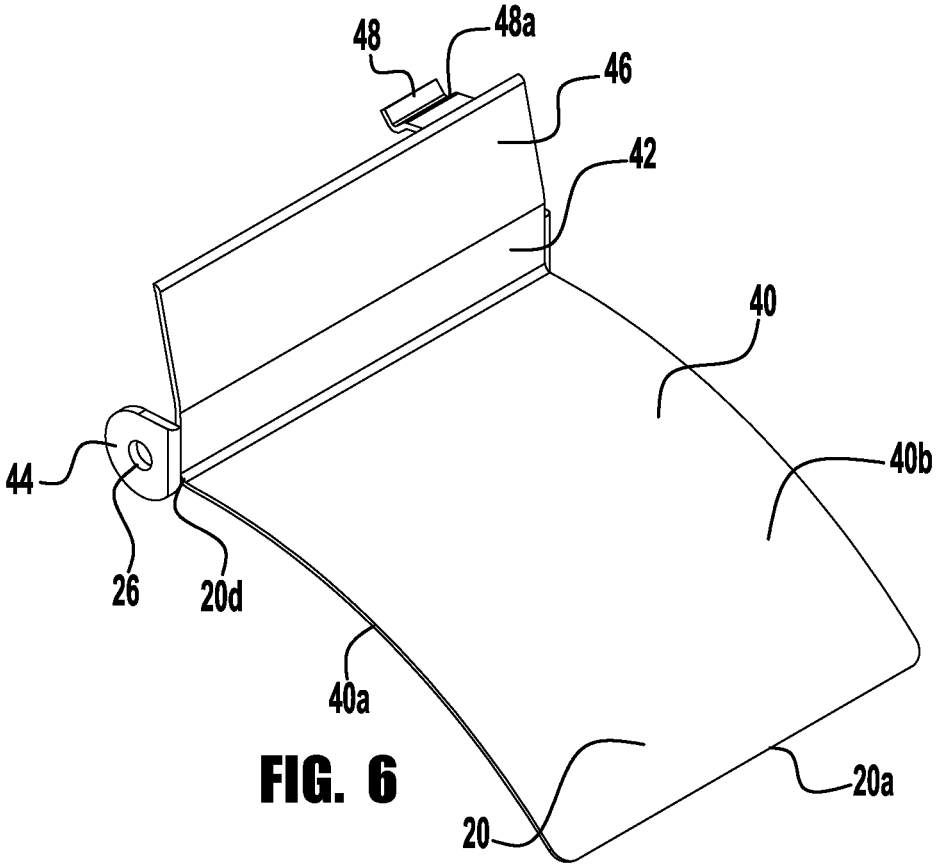

FIG. 6 is a top three dimensional view of the bottom plate of the instrument string cleaner, in accordance with the present invention.

DETAILED DESCRIPTION OF THE INVENTION

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

The instrument string cleaner 10 is a handheld device that will clean the strings 12 and fingerboard 13 of an instrument, preferably a violin 14, while the strings are still on the instrument. It should be noted than the instrument string cleaner 10 may be used with any bowed instrument, including viola, cello, and double bass. String cleaner 10 is specifically designed to accommodate the arc, size, width and spacing of violin strings 12. Because violin strings 12 are at different heights above the fingerboard 13 of violin, the string cleaner 10 is arced to accommodate these differences. The string cleaner 10 is somewhat flexible, as discussed herein below to allows it to be extracted from the violin after cleaning without straining and detuning the strings 12.

FIG. 1 is a top, three-dimensional view of the instrument string cleaner 10 in use on a violin 14. In general terms, the string cleaner 10 utilizes a clamping or clip mechanism 16 that securely connects with and holds onto the violin strings 12.

As shown in FIGS. 2A and 3 and 4, the string cleaner 10 constructed of a top arched plate 20 and a bottom arched plate 22 is illustrated in an open position. The top arched plate 20 and bottom arched plate 22 are held together with a pin 24 that extends the width of the top and bottom plates 20 and 22. A coil spring 31 is disposed with the pin 24 extending through the coiled cylinder of the coil spring. The coil spring 31 normally biases the string cleaner 10 to the closed position, as shown in FIG. 4, were the top and bottom arched plates 20 and 22, respectively, are pressed against each other so as to provide a secure connection with the violin strings 12. Each end 31*a* and 31*b* of the coil spring 31, as shown in FIGS. 3 and 4 extends outward from the coiled cylinder so that 31*a* rests against first finger tab 38 and end 31*b* rests against the inward facing side of the second finger tab 46. In the position shown in FIG. 4, the ends of the spring 31*a* and 31*b* press the first finger tab 38 away from the second finger tab 46 so that the arched portion 40 is disposed against the arched portion 30. In this configuration, there is a secure connection of the microfiber pad, as discussed hereinafter with the strings.

In FIG. 3, the string cleaner 10 is shown in the open position where the top arched plate 20 and the bottom arched plate 22 are separated from each by the bias of the spring 31. Note that in the closed position shown in FIG. 4, the free end 20*a* of the top arched plate 20 is disposed adjacent the interior side 32*a* of the first upright lip 32.

The details of the bottom plate 22 are shown in FIG. 5. The bottom plate 22 has an arched portion 30 that has a convex shape with a bottom side 30*a* adapted to accommodate the arc, size, and width of the fingerboard 13 of an instrument such as a violin, a viola, a cello and a double bass. At one end 30*b* of the arched portion 30 is a first upright lip 32 that projects at approximately a right angle to the upper side 30*c* of arched portion. At the opposite side 30*d* of the arched portion 30 is an upright second lip 34 extending outward from the upper side 30*c* of the arched portion at an angle of between about 45 and 90 degrees. At each end of the upright lip 34 is an upright ear 36 having a pin hole 28 adapted to receive the pin 24. A first finger tab 38 extends outward from the second upright lip 34 in a direction away from and generally parallel to the arched portion 30.

The details of the top plate 20 are shown in FIG. 6. The top plate 20 has an arched portion 40 that has a convex shape with a bottom side 40*a* adapted to have approximately the same shape as the arched portion 30 of the bottom plate 22. The front end 20*a* of the arched portion 40 is adapted to sit adjacent the interior side 32*a* of the first upright lip 32 when the string cleaner 10 is in the closed position as shown in FIG. 4. At the opposite side 20*d* of the arched portion 20 is a second upright lip 42 extending approximately perpendicular to the upper side 40*b* of the arched portion. At each end of the second upright lip 42 is an upright ear 44 having a pin hole 26 there through adapted to receive the pin 24. A second finger tab 46 extends outward from the second upright lip 42 in a direction away from and generally perpendicular to the arched portion 40. A latch clip 48 is disposed at one side of the second finger tab 46 and extends away from the arched portion 40 and generally perpendicular to the second finger tab 46. The latch clip 48 has a bend 48*a* extending across the clip and adapted to snap onto the first finger tab 38 and hold the string cleaner 10 in an open position as shown in FIG. 3.

The bottom and top plates 20 and 22 of the string cleaner 10 are preferably constructed of metal. This is especially true of the bottom plate 22 so that it can be constructed thin enough to fit under the strings, especially under the strings of the instrument at the nut of a violin. However, it is within the terms of the present invention to construct the bottom and top plates 20 and 22 of a semi-rigid moldable material such as plastic, glass reinforced resin, ABS, or polystyrene.

Referring to FIGS. 2A and 2B, the top arched plate 20 has a microfiber pad 50 attached to the bottom surface 40*a* of the arched portion 40 by any means such as gluing the pad to the bottom surface. The bottom arched plate 22 has a microfiber pad 52 attached to the upper side 30*c* of arched portion 30. The pad 52 can extend to and up the inner surface 32*a* of the first upright lip 32. When the string cleaner 10 is in the closed configuration as shown in FIG. 1, the end of the pad 50 rests against the portion of pad 52 on the inner surface 32*a* of the first upright lip 32. Hereto, the microfiber pad 52 can be attached to the upper side 30*c* of arched portion 30 by any means such as gluing the pad to the bottom surface. It should be noted that an additional microfiber pad 54 can be disposed on the concave shaped bottom wall 30*e* of arched portion 30. When the string cleaner 10 is disposed on the strings 13 of the violin 14 as shown in FIG. 1, and moved back and forth along the strings, the microfiber pad 54 simultaneously cleans and buffs the fingerboard 13 of the instrument.

The microfiber pads 50, 52, and 54 can be fixably attached to the top arched plate 20, the bottom arched plate 22 and the concave shaped bottom wall 30*e* of arched portion 30, respectively, by any means known in the art, including but not limited to, an adhesive applied to the backs of the microfiber pads. The microfiber pads 50, 52, and 54 require no cleaning solution, but a solution can be used if desired. The microfiber pads 50, 52, and 54 are designed to provide long term low maintenance use. The microfiber pads 50, 52, and 54 are designed to engulf the strings 12, thereby providing 360 degree cleaning of the strings 12.

The top arched plate 20 and bottom arched plate 22 of the string cleaner 10 allows the user to control the level or power of cleaning action with pressure exerted against the second and first tabs 46 and 38 of the top plate 20 and bottom plate 22, respectively. After the string cleaner 10 is disposed on the strings as shown in FIG. 1, the string cleaner can be moved back and forth along the strings to clean a full 360 degrees around the strings. An aspect of the invention is that the cleaning power of the pads 50 and 52 can be increased by pressing the pads 50 and 52 against each other. This is accomplished by the user holding the first upright lip of the bottom plate 22 and the second finger tab 46 of the top plate 20 and exerting pressure on the second finger tab 46 towards the bottom plate 22. This action causes the pads 50 and 52 of the string cleaner 10 to close more tightly about the strings. The amount of pressure the user exerts on the second finger tab 46 towards the bottom plate 22 allows the user to control the level of cleaning power.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An instrument string cleaner adapted for cleaning the strings of a stringed instrument, comprising:

a clamping mechanism that is adapted to securely connect with and hold onto the strings of a stringed instrument;

the clamping mechanism including a top arched plate and a bottom arched plate held together with a pin that extends the width of the top and bottom plates;

coil spring having the pin extending there through, the coil spring having a free end at either end of the coil spring engaging the top arched plate and the bottom arched plate;

the string cleaner being normally biased to a closed position by the coil spring where the top and bottom arched plates are pressed against each other;

the string cleaner having an open position where the top and bottom arched plates are spaced from each other so that the strings of the instrument can be disposed therebetween;

a first cleaning pad attached to a bottom surface of the top arched plate;

a second cleaning pad attached to a top surface of the bottom arched plate;

the bottom arched plate has a first convex shape adapted to accommodate an arc, size, and width of a fingerboard of the stringed instrument;

one end of the bottom arched plate has a first upright lip that projects upward from the upper side of the bottom arched plate;

an opposite end of the bottom arched plate has a second upright lip extending outward from the upper side of the arched portion;

each end of the second upright lip has an upright ear adapted to receive the pin;

a finger tab extends outward from the second upright lip in a direction away from and generally parallel to the arched portion;

the top plate has an arched portion that has a convex shape with a bottom side adapted to have an approximately same shape as the arched portion of the bottom plate;

the front end of the arched portion of the top plate is adapted to sit adjacent an interior side of the first upright lip when the string cleaner is in the closed position;

at an opposite side of the arched portion of the top plate is a third upright lip extending approximately perpendicular to an upper side of the arched portion of the top plate, wherein at each end of the third upright lip is an upright ear having a pin hole there through adapted to receive the pin;

a first finger tab extending outward from the third upright lip in a direction away from and generally perpendicular to the arched portion of the top plate;

a latch clip is disposed at one side of the second finger tab and extends away from the arched portion of the top plate and generally perpendicular to the second finger tab; and the latch clip has a bend across the clip and is adapted to snap onto the first finger tab and hold it in an open position.

2. The instrument string cleaner of claim 1 wherein the top arched plate has a second convex shape whereby the top and bottom arched plates can be pressed against each other.

3. The instrument string cleaner of claim 1 wherein the first and second cleaning pads are microfiber pads.

4. The instrument string cleaner of claim 1 further including a third cleaning pad attached to the bottom surface of the bottom arched plate to clean the surface of the instrument beneath the strings.

5. The instrument string cleaner of claim 4 wherein the third cleaning pad is a microfiber pad attached to the bottom surface of the bottom arched plate by an adhesive.

6. The instrument string cleaner of claim 1 wherein each of first and second ends of the coil spring extends outward from the coiled cylinder so that the first end rests against the first finger tab and the second end rests against an outer facing side of the second finger tab.

7. The instrument string cleaner of claim 6 wherein the string cleaner has an open position where the top arched plate and the bottom arched plate are separated from each other against the bias of the spring.

8. The instrument string cleaner of claim 6 whereby the coil spring normally biases the string cleaner to a closed position, where the top and bottom arched plates are pressed against each other so as to provide a secure connection with the strings of the stringed instrument.

* * * * *